US009112302B2

(12) United States Patent
Liao et al.

(10) Patent No.: US 9,112,302 B2
(45) Date of Patent: Aug. 18, 2015

(54) ELECTRICAL CONNECTOR AND ASSEMBLY THEREOF

(71) Applicant: HON HAI PRECISION INDUSTRY CO., LTD., New Taipei (TW)

(72) Inventors: Fang-Jwu Liao, New Taipei (TW); Yu-Hung Yen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/265,383

(22) Filed: Apr. 30, 2014

(65) Prior Publication Data

US 2014/0329415 A1 Nov. 6, 2014

(51) Int. Cl.

| | |
|---|---|
| ***H01R 12/79*** | (2011.01) |
| ***H01R 12/59*** | (2011.01) |
| ***H01R 12/71*** | (2011.01) |
| ***H01R 12/77*** | (2011.01) |

(52) U.S. Cl.

CPC ..... *H01R 12/598* (2013.01); *H01R 12/716* (2013.01); *H01R 12/777* (2013.01)

(58) Field of Classification Search

CPC ..... H01R 12/777; H01R 12/79
USPC ..... 439/493
See application file for complete search history.

(56) References Cited

U.S. PATENT DOCUMENTS

| | | | | |
|---|---|---|---|---|
| 6,280,239 | B1 * | 8/2001 | Cheng | 439/495 |
| 6,500,013 | B1 * | 12/2002 | Wang | 439/108 |
| 6,722,915 | B1 * | 4/2004 | McAlonis et al. | 439/498 |
| 6,824,419 | B1 * | 11/2004 | Wu | 439/378 |
| 6,830,478 | B1 * | 12/2004 | Ko | 439/579 |
| 7,059,893 | B2 * | 6/2006 | Ono et al. | 439/495 |
| 7,207,842 | B1 * | 4/2007 | Kenjo | 439/607.01 |
| 7,273,390 | B2 * | 9/2007 | Iida et al. | 439/494 |
| 7,367,820 | B2 * | 5/2008 | Kikuchi | 439/108 |
| 7,377,803 | B2 * | 5/2008 | Matsuoka | 439/497 |
| 7,430,801 | B2 * | 10/2008 | Iida et al. | 29/883 |
| 7,458,822 | B2 * | 12/2008 | Ono | 439/74 |
| 7,465,186 | B2 * | 12/2008 | Yotsutani | 439/497 |
| 7,789,678 | B2 * | 9/2010 | Nagata et al. | 439/108 |
| 7,927,122 | B2 * | 4/2011 | Yamaji et al. | 439/342 |
| 8,043,114 | B2 * | 10/2011 | Kaneko et al. | 439/497 |
| 8,075,324 | B2 * | 12/2011 | Yamaji et al. | 439/188 |
| 8,388,370 | B2 * | 3/2013 | Yamaji et al. | 439/497 |
| 8,585,433 | B2 * | 11/2013 | Honda | 439/499 |
| 8,602,812 | B2 * | 12/2013 | Ohsaka | 439/497 |
| 8,894,433 | B2 * | 11/2014 | Little et al. | 439/378 |
| 2002/0006744 | A1 * | 1/2002 | Tashiro | 439/329 |

(Continued)

*Primary Examiner* — Ross Gushi
(74) *Attorney, Agent, or Firm* — Wei Te Chung; Ming Chieh Chang

(57) ABSTRACT

An electrical connector for connecting a plurality of cables with a PCB comprises an insulating housing and a plurality of first and second contacts received therein. The insulating housing comprises a first mounting surface and a second mounting surface parallel to each other and a tongue portion extending downwardly in an up-to-down direction. The first mounting surface is lower than the second mounting surface in the up-to-down direction forming a stepped surface. The tongue portion extends far away from the stepped surface and comprises opposite periphery surfaces. The first contact comprises a first connecting portion on the first mounting surface and a first contacting portion extending along one periphery surface of the tongue portion while the second contact comprises a second connecting portion on the second mounting surface and a second contacting portion extending along the other periphery surface of the tongue portion.

20 Claims, 9 Drawing Sheets

(56) References Cited

U.S. PATENT DOCUMENTS

| | | | | |
|---|---|---|---|---|
| 2007/0141871 | A1* | 6/2007 | Scherer et al. | 439/108 |
| 2008/0242139 | A1* | 10/2008 | Matsuoka | 439/357 |
| 2009/0227138 | A1* | 9/2009 | Lv et al. | 439/466 |
| 2010/0159740 | A1* | 6/2010 | Zhang | 439/499 |
| 2010/0291787 | A1* | 11/2010 | Kuo | 439/352 |
| 2013/0316566 | A1* | 11/2013 | Little et al. | 439/378 |
| 2014/0017953 | A1* | 1/2014 | Iwano et al. | 439/660 |
| 2014/0113475 | A1* | 4/2014 | Malek et al. | 439/306 |
| 2014/0120788 | A1* | 5/2014 | Kodaira et al. | 439/892 |
| 2014/0141628 | A1* | 5/2014 | Hsu | 439/67 |
| 2014/0148021 | A1* | 5/2014 | Hsu | 439/67 |
| 2014/0302692 | A1* | 10/2014 | Raff et al. | 439/65 |
| 2014/0304985 | A1* | 10/2014 | Nagase et al. | 29/747 |
| 2014/0308825 | A1* | 10/2014 | Hashiguchi | 439/66 |
| 2014/0329415 | A1* | 11/2014 | Liao et al. | 439/660 |
| 2014/0377971 | A1* | 12/2014 | Mathews et al. | 439/153 |

* cited by examiner

ELECTRICAL CONNECTOR AND ASSEMBLY THEREOF

BACKGROUND OF THE INVENTION

1. Field of the Invention

The present disclosure relates to an electrical connector, and more particularly to an electrical connector connecting cables with a printed circuit board (PCB).

2. Description of the Related Art

U.S. Patent Publication No. 20090227138 discloses an electrical connector. The electrical connector comprises an insulating housing and a plurality of contacts received in the insulating housing. The contacts are arranged into two rows in a longitudinal direction and the contacts in different rows comprise connecting beams thereof extending in two opposite directions perpendicular to the longitudinal direction. Tow rows of cables are assembled onto the connecting beams respectively and extend in the opposite directions. As the contacts and the cables are divided into two rows, the longitudinal dimension of the electrical connector could be reduced even if the number of the cables increases. However, as the cables extend in two opposite directions, the arrangement of the cables occupy more space in said two opposite directions and can not meet the miniaturization tendency of the electrical connector.

In view of the above, an improved electrical connector is desired to overcome the problems mentioned above.

SUMMARY OF THE INVENTION

Accordingly, an object of the present disclosure is to provide an electrical connector for miniaturization.

In order to achieve the object set forth, an electrical connector for connecting a plurality of cables is provided. The electrical connector comprises an insulating housing comprising a first mounting surface and a second mounting surface parallel to each other and a tongue portion extending downwardly in an up-to-down direction, the first mounting surface lower than the second mounting surface in the up-to-down direction forming a stepped surface, the tongue portion extending far away from the stepped surface and comprising opposite periphery surfaces; and a plurality of contacts received in the insulating housing, the contacts comprising first contacts and second contacts, the first contact comprising a first connecting portion on the first mounting surface and a first contacting portion extending along one periphery surface of the tongue portion while the second contact comprising a second connecting portion on the second mounting surface and a second contacting portion extending along the other periphery surface of the tongue portion.

DESCRIPTION OF PREFERRED EMBODIMENT

Reference will now be made to the drawings to describe the present disclosure in detail.

Figure 1:
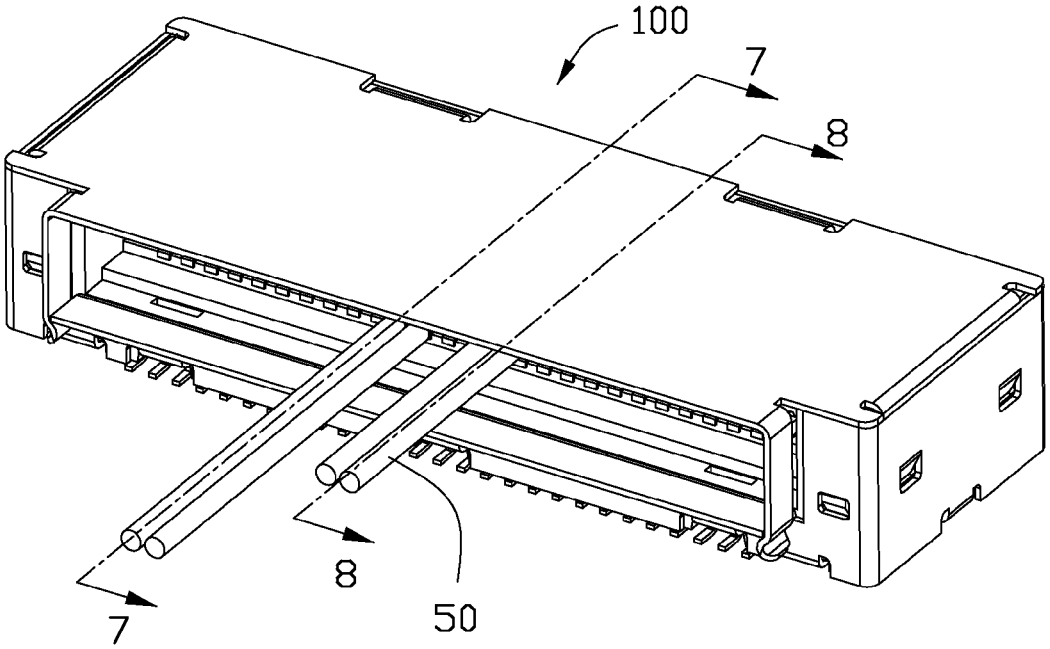
FIG. 1 is an assembled, perspective view of an electrical connector assembly in accordance with a preferred embodiment of the present disclosure.
Figure 2:
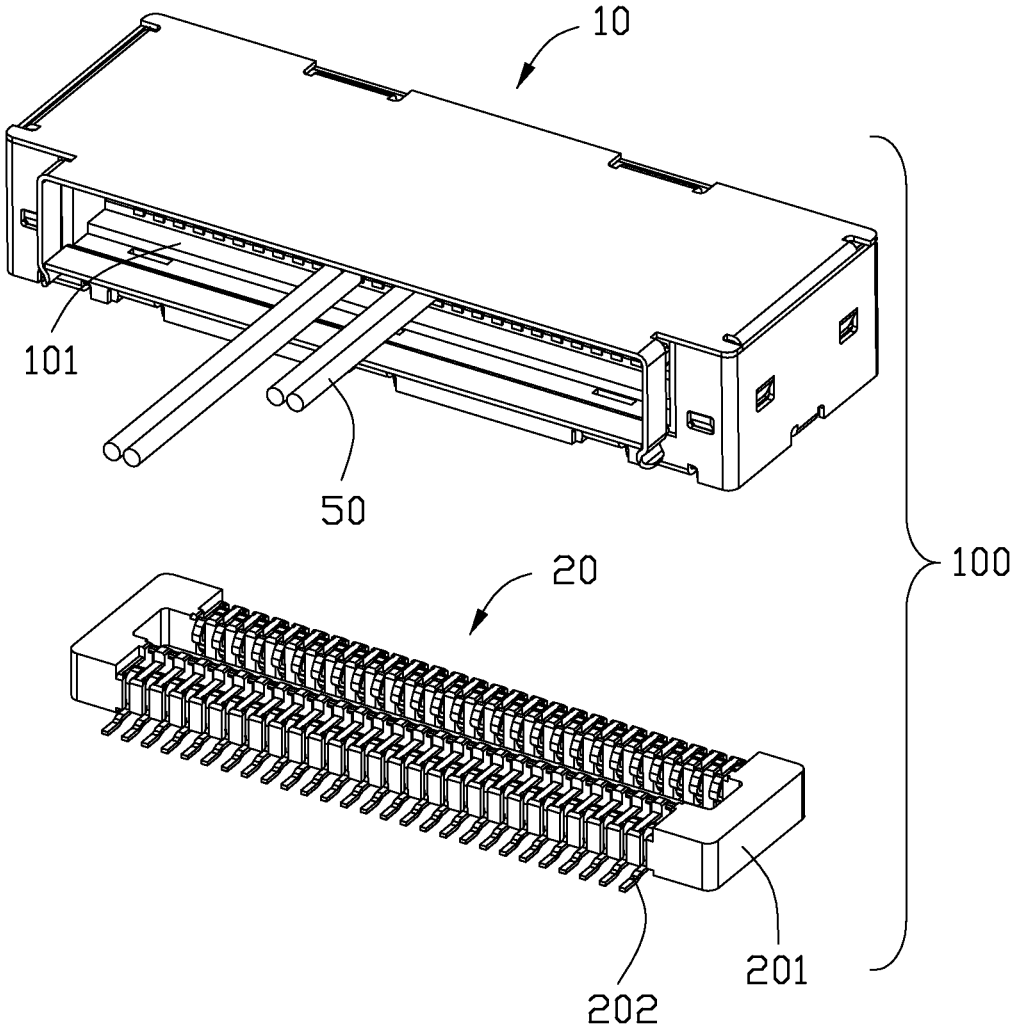
FIG. 2 is an exploded, perspective view of the electrical connector assembly shown in FIG. 1.
Figure 3:
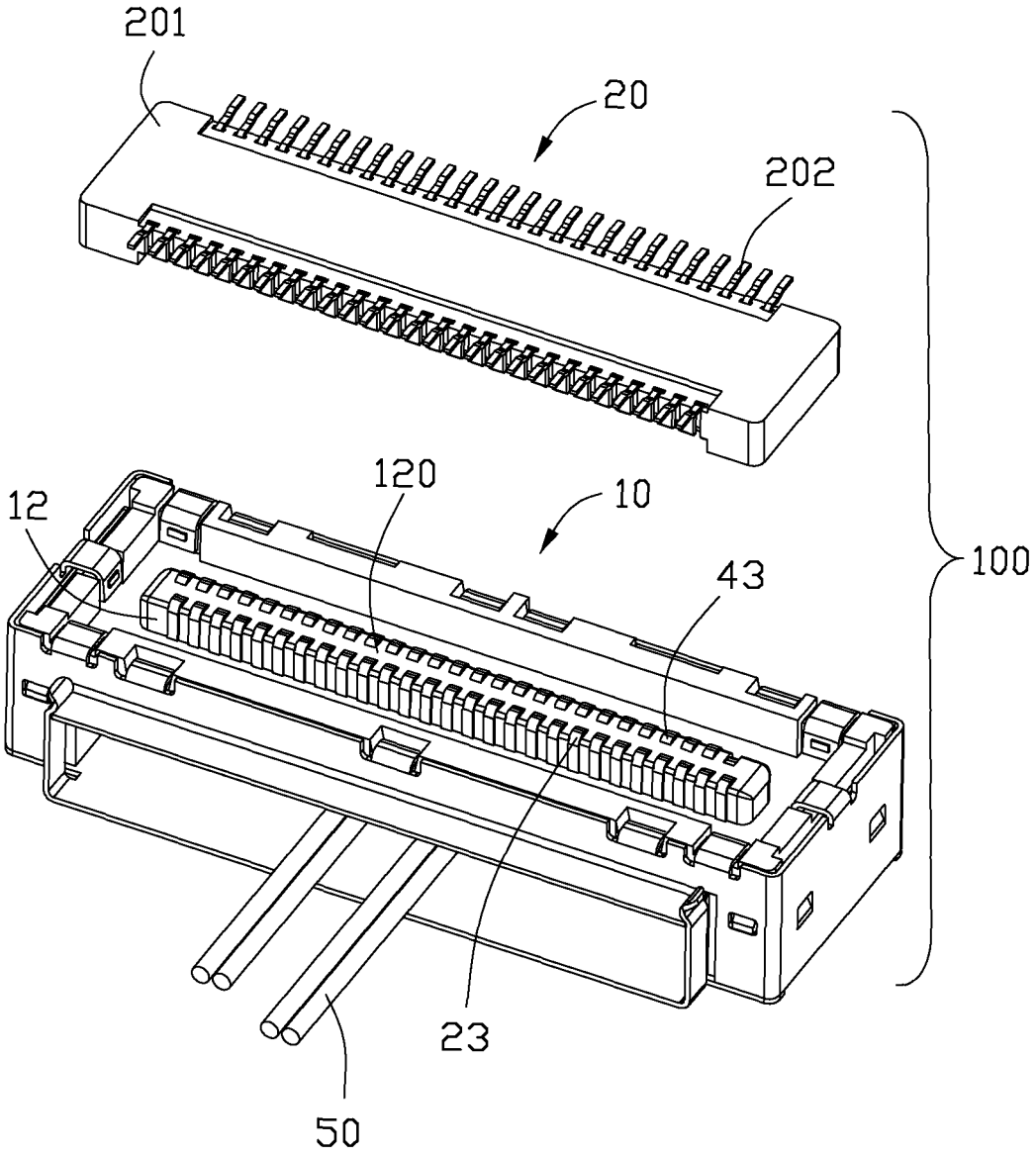
FIG. 3 is another view of the electrical connector assembly shown in FIG. 2.

Referring to FIGS. 1 to 3, an electrical connector assembly 100 for electrically connecting a plurality of cables 50 with a printed circuit board (PCB) (not show) is provided. The electrical connector assembly 100 comprises a plug electrical connector and a receptacle electrical connector. In the instant invention, the plug electrical connector is a cable end connector 10 and while the receptacle electrical connector is a board end connector 20 matching with the cable end connector 10.

Figure 4:
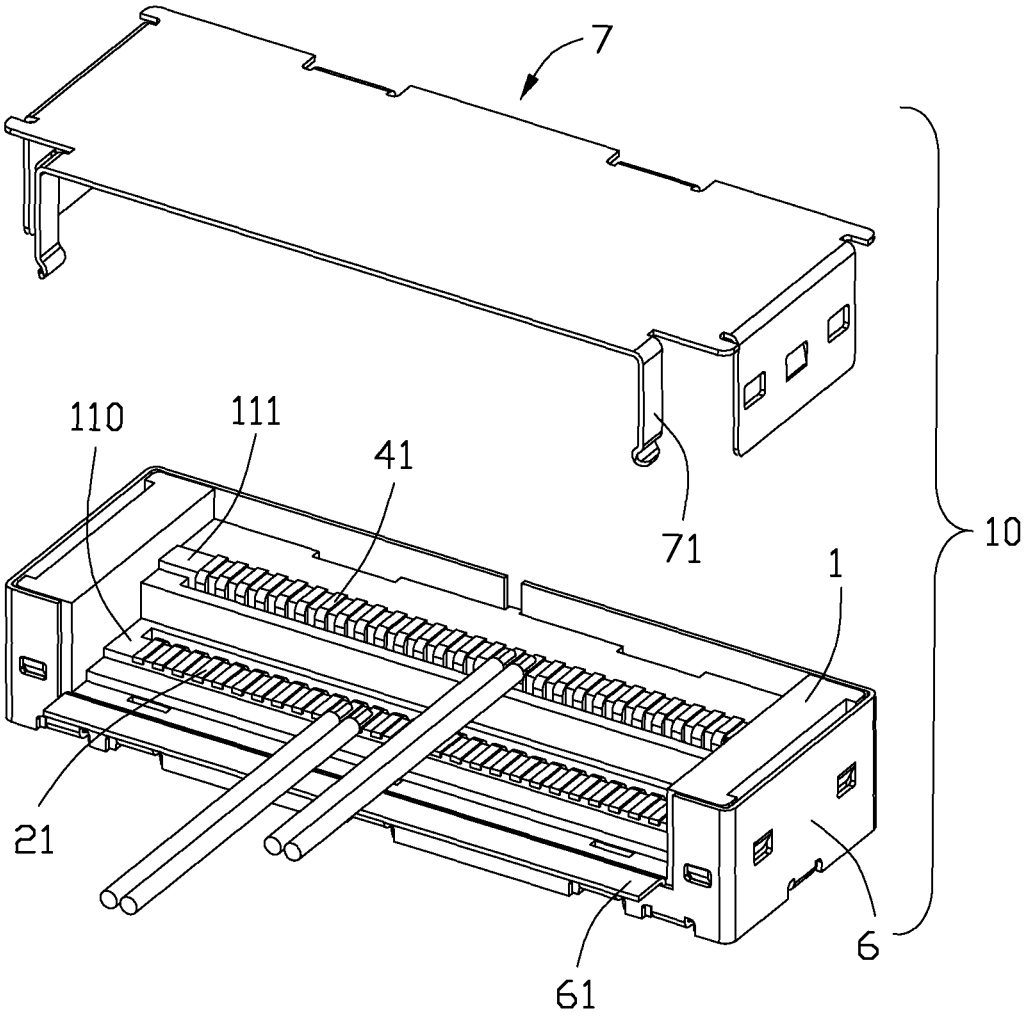
FIG. 4 is a perspective view of a cable end connector of the electrical connector assembly shown in FIG. 1.
Figure 5:
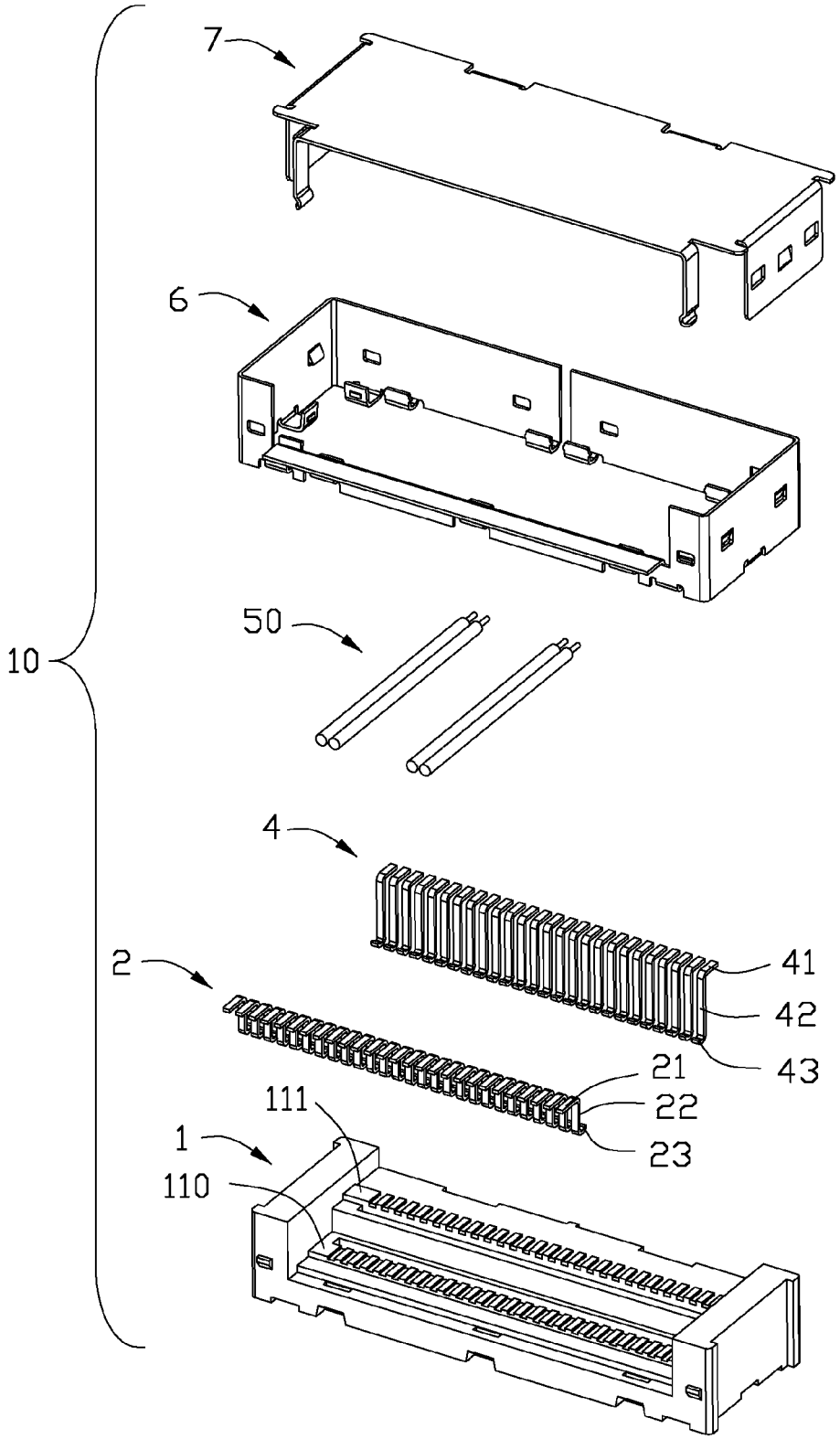
FIG. 5 is an exploded, perspective view of the cable end connector shown in FIG. 4.

Referring to FIG. 4 and FIG. 5, the cable end connector 10 comprises an insulating housing 1 and a plurality of contacts 2, 4 received therein. The contacts comprise a plurality of first contacts 2 and a plurality of second contacts 4 each arranged in a row. In this embodiment, the contacts 2, 4 are insert-molded in the insulating housing 1. The insulating housing 1 comprises mounting surfaces for supporting the cables 50. The mounting surfaces comprises a first mounting surface 110 and a second mounting surface 111 parallel with each other. The first mounting surface 110 is lower than the second mounting surface 111 in an up-to-down direction perpendicular to the first and second mounting surfaces, forming a stepped structure. The first mounting surface 110 is defined as lower mounting surface while the second mounting surface 111 is defined as upper mounting surface. The stepped structure of the insulating housing 1 defines an opening 101 for the cables 50 extending therethrough. The insulating housing 1 comprises a tongue portion 12 extending downwardly and far away from the mounting surfaces for inserting into the board end connector 20. The tongue portion 12 comprises two opposite periphery surfaces and a matching surface 120 opposite to the mounting surfaces.

Referring to FIG. 5, the first contact 2 comprises a first connecting portion 21, a first contacting portion 22 bent squarely from the first connecting portion 21 and a first hook portion 23 bent from the first contacting portion 22. The structure of the second contact 4 is substantially the same with the first contact 2. The second contact 4 comprises a second connecting portion 41, a second contacting portion 42 bent squarely from the second connecting portion 41 and a second hook portion 43 bent from the second contacting portion 42. The difference between the first and second contacts is that the length of the second contacting portion 42 is longer than the first contacting portion 22 in the up-to-down direction. Referring to FIG. 4, the first connecting portion 21 is on the first mounting surface 110 while the second connecting portion 41 is on the second mounting surface 111. The first connecting portion 21 is lower than the second connecting portion 41. The first contact 2 is defined as the lower contact while the second contact 4 is defined as the upper contact. The first connecting portion 21 is closer the opening 101 of the insulating housing than the second connecting portion 41. The first connecting portion 21 extends opposite to and far away from the second connecting portion 41. The free ends of the first and second connecting portions 21, 41 connect carriers (not show). The carriers are opposite to each other before removing from the contact. The cables 50 are arranged into two rows in the up-to-down direction corresponding to the first and second connecting portions 21, 41. Said two rows of the cables 50 extend towards the same direction. The free end of the first connecting portion 21 faces the direction that the cable extending towards; while a right angle portion of the second connecting portion 41 and the second contacting portion 42 faces the direction that the cable extending towards. Referring to FIG. 3, the first and second contacting portions 22, 42 extend along the periphery surfaces of the tongue portion 12. The first and second hook portions 23, 43 locate on the matching surface 120 of the tongue portion 12.

Figure 6:
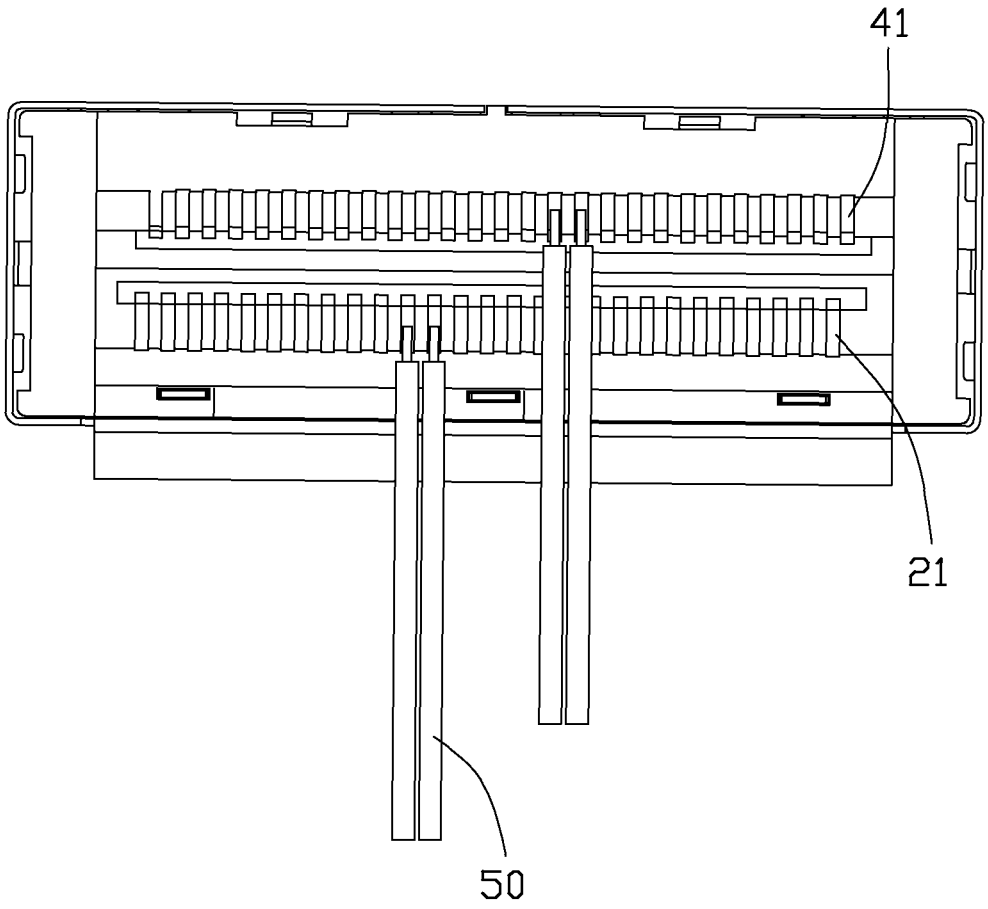
FIG. 6 is a top view of the electrical connector assembly shown in FIG. 1.
Figure 7:
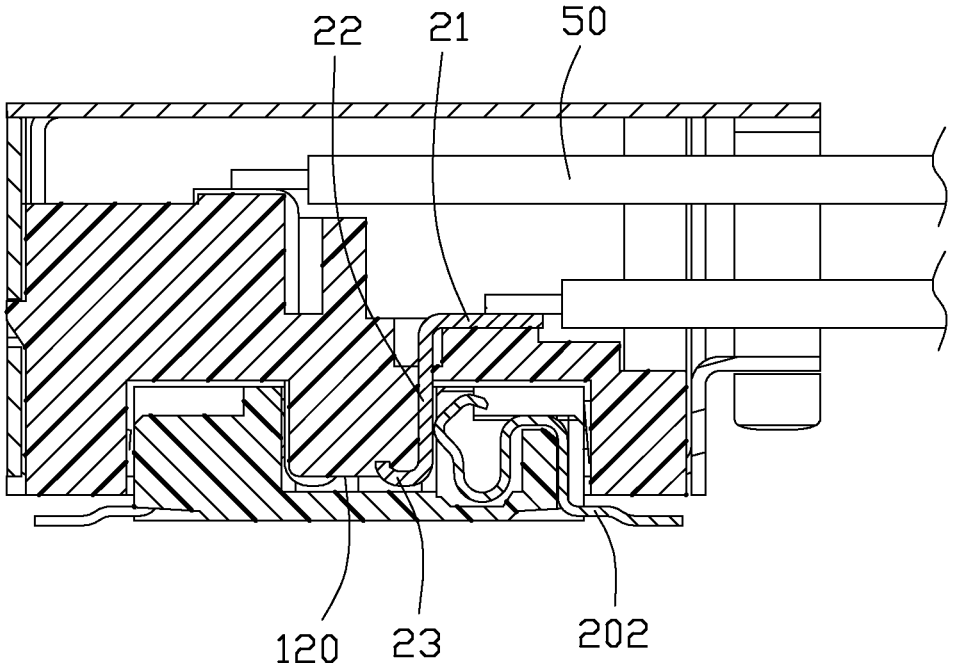
FIG. 7 is a cross sectional view of the electrical connector assembly shown in FIG. 1 along line 7-7.
Figure 8:
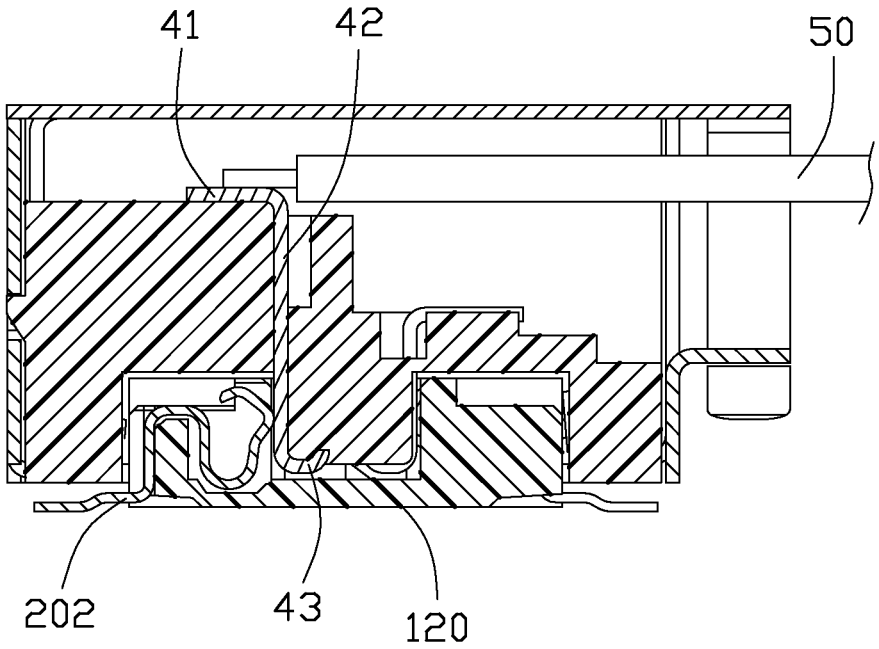
FIG. 8 is a cross sectional view of the electrical connector assembly shown in FIG. 1 along line 8-8.

Referring to FIGS. 6-8, in a top view, the first contacts 2 are half pitch offset from the second contacts 4 for convenient arrangement of the cables 50 assembled thereon. The board end connector 20 comprises a main body 201 defining a cavity for accommodating the tongue portion 12 of the cable end connector 10 and a plurality of matching contacts 202 extending into the cavity for contacting the contacts 2, 4 of the cable end connector 10. The matching contacts 202 are soldered on the PCB.

Furthermore, the cable end connector 10 comprises a metallic shell for protection and anti-EMI. The shell comprises a frame 6 surrounding the insulating housing 1 and a cover 7 assembled on the frame 6. The frame 6 comprises a tab 61 at the opening side of the insulating housing 1 while the cover 7 comprises a pair of latches 71 extending downwardly engaging the tab 61.

Figure 9:
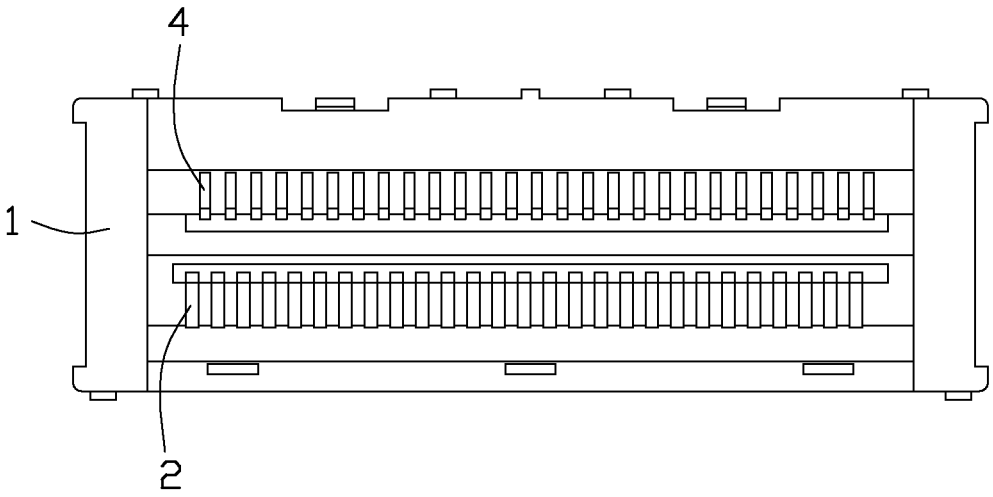
FIG. 9 is a top view of a cable end connector in accordance with another embodiment.

FIG. 9 is another embodiment of the present disclosure where the width of the first connecting portion 21 is wider than the second connecting portion 41 so as to improve the high frequency performance.

According to the above described embodiments, a cable end connector 10 comprising first and second mounting surfaces 110, 111 in different plane is provided. The first and second mounting surfaces 110, 111 define a stepped structure; the cables 50 supported by the first and second mounting surfaces 110, 111 form an upper row and a lower row for convenient arrangement thereof The cables 50 of upper row and the lower row extend in the same direction so as to take advantage of the space of the connector itself and meet the requirement of miniaturization.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for connecting a plurality of cables, comprising:

an insulating housing comprising a first mounting surface and a second mounting surface parallel to each other and a tongue portion extending downwardly in an up-to-down direction, the first mounting surface lower than the second mounting surface in the up-to-down direction forming a stepped surface, the tongue portion extending far away from the stepped surface and comprising opposite periphery surfaces; and a plurality of contacts received in the insulating housing, the contacts comprising first contacts and second contacts, the first contact comprising a first connecting portion on the first mounting surface and a first contacting portion extending along one periphery surface of the tongue portion while the second contact comprising a second connecting portion on the second mounting surface and a second contacting portion extending along the other periphery surface of the tongue portion.

2. The electrical connector as claimed in claim 1, wherein a width of the first connecting portion is wider than that of the second connecting portion.

3. The electrical connector as claimed in claim 1, wherein the cables are arranged into two rows corresponding to the first and second connecting portions while the cables of two rows extend in the same direction.

4. The electrical connector as claimed in claim 3, wherein the first connecting portion and the second connecting portion extend opposite to each other.

5. The electrical connector as claimed in claim 1, wherein the second contacting portion is longer than the first contacting portion in the up-to-down direction.

6. The electrical connector as claimed in claim 5, wherein the first contact comprises a first hook portion bent from the first contacting portion while the second contact comprises a second hook portion bent from the second contacting portion, the first hook portion and the second hook portion are arranged in a face-to-face manner.

7. The electrical connector as claimed in claim 6, wherein the tongue portion comprises a matching surface opposite to the mounting surfaces, the first and second hook portions are defined on the matching surface.

8. The electrical connector as claimed in claim 1, wherein the first contacts are half pitch offset from the second contacts from a top view.

9. The electrical connector as claimed in claim 1, wherein the electrical connector further comprises a metallic frame surrounding the insulating housing and a cover assembled on the frame.

10. The electrical connector as claimed in claim 9, wherein the frame comprises a tab while the cover comprises a pair of latches extending downwardly engaging the tab.

11. An electrical connector assembly for electrically connecting cables to a printed circuit board (PCB), comprising:

a plug connector for assembling the cables, the plug connector comprising an insulating housing and a plurality of contacts received in the insulating housing, the insulating housing comprising a tongue portion, the contacts divided into two rows and located on two opposite side of the tongue portion; and a receptacle connector mating the plug connector, the receptacle connector comprising an cavity for receiving the tongue portion and a plurality of matching contacts extending into the cavity for contacting the contacts of the plug connector, wherein;

the insulating housing of the plug connector comprises an upper mounting surface and a lower mounting surface on different planes in an up-to-down direction forming a stepped surface, the contacts comprise connecting portions corresponding on the upper and lower mounting surfaces and arranged into an upper row and a lower row, the cables are assembled on the connecting portions of the upper and lower rows and extend out in the same direction.

12. The electrical connector assembly as claimed in claim 11, wherein the upper row connecting portions and the lower row connecting portion extend opposite to and far away from each other.

13. The electrical connector assembly as claimed in claim 11, wherein the upper and lower rows contacts comprise contacting portions extending along periphery of the tongue portion, and wherein the contacting portion of the upper row contact is longer than the contacting portion of the lower row contact.

14. The electrical connector assembly as claimed in claim 13, wherein the contacting portion is squarely bent from the connecting portion, the free end of the lower row connecting portion and the right angle of the upper row connecting portion face the direction that the cable extending out.

15. The electrical connector assembly as claimed in claim 11, wherein the lower row connecting portion is wider than the upper row connecting portion and half pitch offset with each other.

16. An electrical connector assembly comprising:

a plug connector including:

an elongated insulative housing unitarily forming an elongated tongue portion horizontally extending in a longitudinal direction and downwardly in a vertical direction perpendicular to said longitudinal direction, with thereon opposite mating faces spaced from each other in a transverse direction perpendicular to both the longitudinal direction and the vertical direction;

first and second rows of contacts disposed in the housing and spaced from each other in the transverse direction while each row extending along the longitudinal direction, each of said contacts including a contacting section extending in the vertical direction and seated upon the corresponding mating face in a flat manner, a hook section located at a bottom end of the contacting section and extending into the tongue portion in the transverse direction, and a connecting section located at a top end of the contacting section and extending in a horizontal manner in the transverse direction opposite to the hook section;

a cable unitarily including upper and lower rows of wires mechanically and electrically connected to the connecting section of the corresponding contacts, respectively; wherein the connecting sections of the contacts in the first row and those of the contacts in the second row away extend from each other in said transverse direction and are located at different levels in the vertical direction; wherein the connecting sections of the contacts in first row extending away from the corresponding wires, are located at the level higher than said another level which those of the contacts in the second row extending toward the corresponding wires are located at.

17. The electrical connector assembly as claimed in claim 16, wherein the first row of contacts, which are farther from the cable than the second row of contacts, are longer than the second row of contacts.

18. The electrical connector assembly as claimed in claim 17, wherein the first row of contacts are narrower than the second row of contacts.

19. The electrical connector assembly as claimed in claim 18, further including a receptacle connector defining another insulative housing with a mating cavity to receive the tongue portion therein during mating, wherein two rows of terminals are disposed in said another housing and by two sides of the mating cavity, and said two rows of terminals share a same configuration and dimension in a symmetrical manner.

20. The electrical connector assembly as claimed in claim 16, wherein the first row of contacts and the second row of contacts are offset from each other in the longitudinal direction.

* * * * *